United States Patent [19]

Card et al.

[11] Patent Number: 4,815,403

[45] Date of Patent: Mar. 28, 1989

[54] CUT LOOP OVER CUT PILE FABRIC AND APPARATUS FOR AND METHOD OF PRODUCING THE SAME

[75] Inventors: Roy T. Card; Joseph L. Card, both of Chattanooga, Tenn.

[73] Assignee: Card-Monroe Corporation, Chattanooga, Tenn.

[21] Appl. No.: 142,925

[22] Filed: Jan. 12, 1988

[51] Int. Cl.[4] ..... D05C 15/22

[52] U.S. Cl. ..... 112/80.51; 112/80.52; 112/80.41

[58] Field of Search ..... 112/80.52, 80.51, 80.41, 112/80.56, 80.54

[56] References Cited

U.S. PATENT DOCUMENTS

| | | | |
|---|---|---|---|
| 3,084,645 | 4/1963 | Card | 112/80.51 |
| 3,138,126 | 6/1964 | Card | 112/80.51 |
| 3,396,687 | 8/1968 | Nowicki | 112/80.41 |
| 3,865,059 | 2/1973 | Jackson | 112/80.3 L |
| 4,103,629 | 8/1978 | Card | 112/80.51 |
| 4,155,319 | 5/1979 | Short | 112/80.51 |

*Primary Examiner*—Ronald Feldbaum

*Attorney, Agent, or Firm*—Hurt, Richardson, Garner, Todd & Cadenhead

[57] ABSTRACT

Laterally shiftable front and back needle bars are slideably mounted on a main needle bar, the front needle bar carries a front row of needles and a back needle bar carries a back row of needles. Cut pile loopers cooperate with the needles of the back row and cut-loop loopers cooperate with the needles of the front row. Needles in the front row are larger and handle larger size yarns than needles in the back row and a yarn feed control dictates whether yarns in the front needles make low loops or high cut piles.

8 Claims, 1 Drawing Sheet

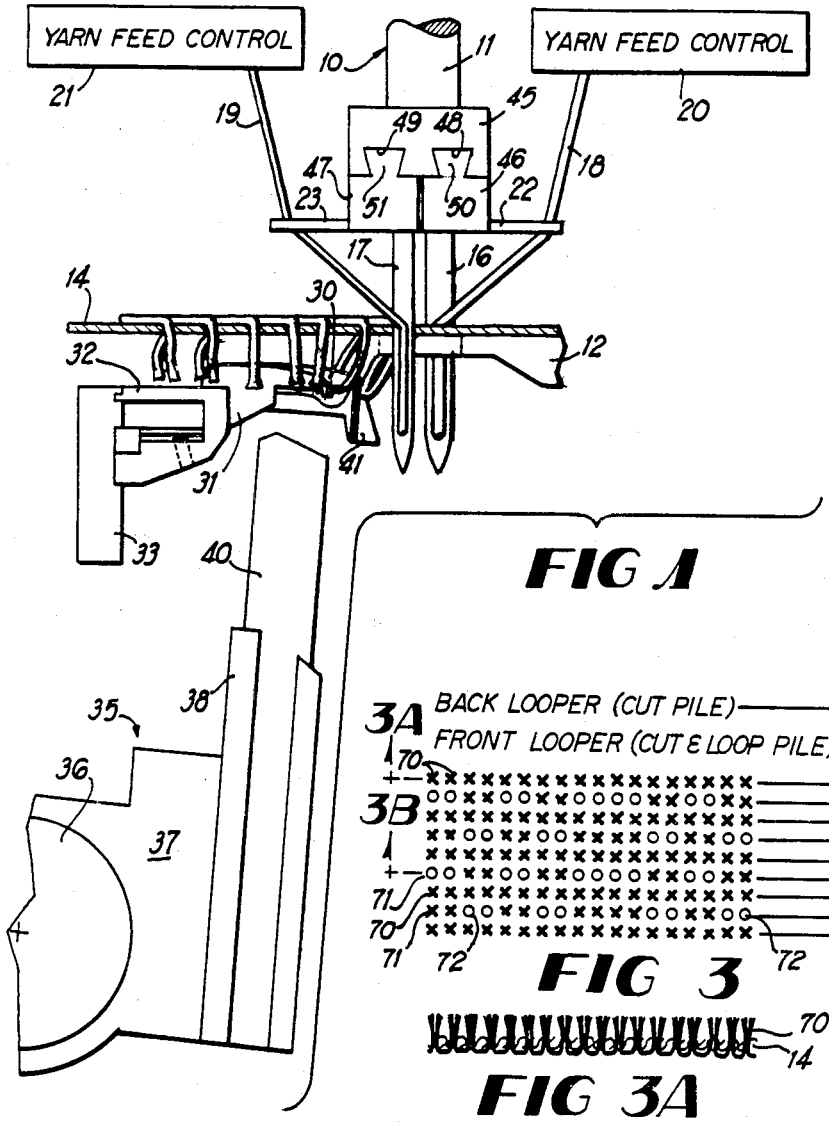
FIG 1
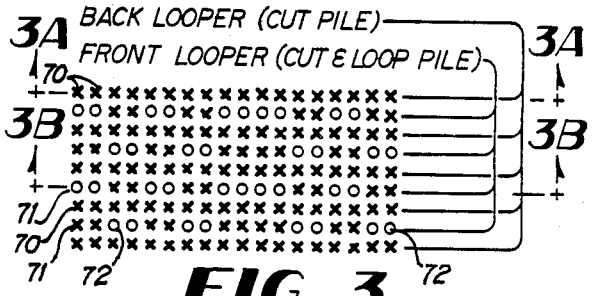
FIG 3
FIG 3A
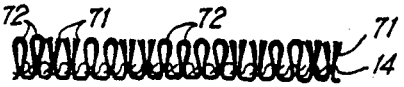
FIG 3B
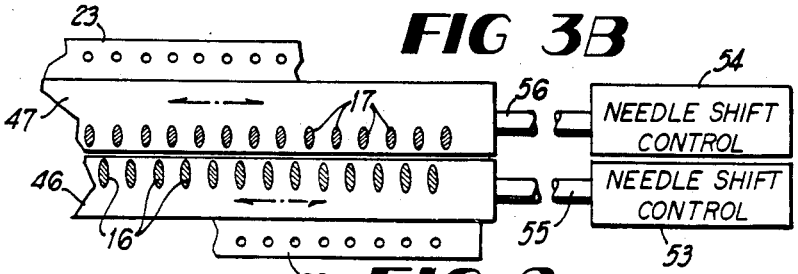
FIG 2

CUT LOOP OVER CUT PILE FABRIC AND APPARATUS FOR AND METHOD OF PRODUCING THE SAME

BACKGROUND OF THE INVENTION

This invention relates to tufting machines and to fabrics produced therefrom and is more particularly concerned with cut and loop over cut pile fabric and to an apparatus for and process of producing the same.

In the past, tufting machines using needles with cut pile loopers and cut loop loopers have been produce in which each cut-loop looper has a clip for selectively retaining or releasing a loop, the retained loops being subsequently cut to provide a fabric having high cut tufts and low loop tufts in longitudinally aligned rows of tufts in a backing fabric. Such cut and loop tufts were formed according to a pattern dictated by a pattern controlled yarn feed mechanism. U.S. Pat. No. 4,103,629 to Card discloses such a machine. Other similar machines are disclosed in U.S. Pat. No. 2,982,239 to McCutchen, U.S. Pat. No. 3,084,645 to Card and U.S. Pat. No. 3,138,126 to Card.

Using the previously patented machines described above, it is very different to make fine gauge fabrics since the narrow gauge machines require needles with small eyes and thus are limited to using small diameter yarns which will pass through such needle eyes.

BRIEF DESCRIPTION OF THE INVENTION

Briefly described, the apparatus of the present invention includes tufting machine with front and back needle bars, each of which is reciprocated, vertically. The needle bars each carry a row of needles and are respectively shiftable, laterally by individual needle shift controls. Yarn feed controls respectively control the feed of the yarn to the two rows of needles. The cut loop loopers have side clips which cause the cut-loop loopers selectively to release or retain a loop after a subsequent loop has been sewn. The retained loops are cut by knives. The needles of the front needle bar sew in zigzag or straight paths as prescribed by one of the needle shift controls and the needles of the back needle bar sew also in zig-zag or straight paths producing only cut tufts or piles. The cut loop loopers protrude beyond the ends of the cut loop loopers and since there is a greater operating space between the ends of the cut loop looper, larger needles are used for the forward row of needles.

Accordingly, it is an object of the present invention to provide a tufting machine which will sew cut and loop piles in parallel, longitudinal rows in which the spacing between rows can be quite close, such as 1/10 inch or 5/64 inch.

Another object of the present invention is to provide a tufting machine which is capable of producing narrow gauge fabric, the machine using needles which have larger eyes than comparable prior art machines.

Another object of the present invention is to provide a tufting machine for producing cut and loop tufts wherein large yarn sizes may be used for producing some cut and all of the loop tufts and in which imperfections in yarns will easily pass through the eyes of the needles employed for these cut and loop tufts.

Another object of the present invention is to provide a tufting machine for producing cut and loop tufts from random slub yarns.

Another object of the present invention is to provide a tufting machine for producing cut and loop tufts the machine being capable of producing a much denser tufted cut and loop pile fabric.

Another object of the present invention is to provide a tufting machine for producing cut and loop pile fabric which has a low pile height and more tufts per inch than is capable of being readily produced using conventional machines.

Another object of the present invention is to provide a tufting machine and process which will produce a dense patterned fabric in a multicolor, the fabric giving the appearance of being a totally cut pile fabric.

Another object of the present invention is to provide a multicolor or a single color tufted fabric which is produced from cut pile and loop piles, the fabric having a dense and patterned appearance.

Other objects, features and advantages of the present invention will become apparent from the following description when considered in conjunction with the accompanying drawings wherein like characteristics of reference designate corresponding parts.

DESCRIPTION OF THE DRAWINGS

FIG. 1 is a fragmentary vertical sectional view of a tufting machine constructed in accordance with the present invention;

FIG. 2 is a fragmentary schematic horizontal sectional view of a portion of the tufting machine depicted in FIG. 1 and showing a portion of the needle bars, needles and needle shift controls of the present invention;

FIG. 3 is a schematic illustration of one form of tufting accomplished by the tufting machine of the present invention;

FIG. 3A is a horizontal sectional view taken substantially along line 3A—3A; and FIG. 3B is a horizontal sectional view taken substantially along line 3B—3B.

DETAILED DESCRIPTION

Referring now in detail to the embodiment chosen for the purpose of illustrating the present invention, numeral 10 denotes generally a cut pile tufting machine, such as disclosed in the Roy T. Card U.S. Pat. No. 4,103,629 issued Aug. 1, 1978. The machine 10 thus has reciprocating vertically moveable, push rods, such as rod 11, which reciprocate in axial directions along vertical paths, toward and away from a bed 12. A base fabric or backing material 14 is moved progressively in the direction of the arrow in FIG. 1 as the front needles 16 and rear needles 17 insert the yarns 18 and 19 through the backing material 14. Yarn feed controls 20 and 21 feed yarns 18 and 19 respectively to the needles 16 and 17 through yarn guides 22 and 23. Needles 16 and 17 form loops of yarns 18 and 19 in the backing material 14, such loops being caught by loopers, such as front loopers 30 and back loopers 31 carried by common side-by-side looper bars, such as bar 32. The looper bars, such as looper bar 32, are mounted on a reciprocating looper bar mounting member 33 which is reciprocated in synchronization with the reciprocation of the needles 16 and 17.

A knife holder assembly 35 disposed below the loopers, includes a rocker shaft 36 provided with radially extending rocker arms 27 which support juxtaposed knife holders, such as knife holder 38. Looper knives, such as knife 40, are supported by the knife holder 38 and biased for cutting action against one side of each of loopers 30 and 31. Each knife 40 cooperates with an individual looper 30 or 31.

Each looper 30 is a conventional cut-loop looper which tapers forwardly to a rounded end or tip and has associated, therewith, a spring clip 41 secured by its base to a side of the shank of the looper 30. This spring clip 41 extends forwardly below one side of the looper 30 and has an upstanding forward portion, the front end is biased against the side of the forward end portion of looper 30. Each time the looper 30 approaches needle 16, the clip 41 is cammed open by its needle 16 to shed a loop which was previously formed, in the event that insufficient yarn has been fed to the needle so that yarn is robbed from the preceeding loop.

The loopers 31 are conventional cut pile loopers, each having a bill or tip which terminates rearwardly of the tips of the loopers 30. Thus, as the loopers 20 and 21 are reciprocated forwardly and rearwardly, the front looper 30 catches the loops created by the front row of needles 16 and the rear loopers 21 catch the loops of yarns sewn by the rear needles 17. U.S. Pat. No. 4,103,629 discloses much of the mechanism discussed above.

According to the present invention, the front row of needles 16 ar relatively large needles and thus have relatively large eyes. The yarns 18, fed to these needles 16, are thus relatively large in diameter or size and any knots, slubs, glue joints and the like on yarns 18 will pass through the eye. Since the loopers 30, which cooperate with these large front needles 16, are between and protrude forwardly beyond adjacent loopers 31 these large needles 16 can be relatively close to each other.

The amount of yarn 18 fed to each needle 16 is controlled by yarn feed control 20. If insufficient yarn is fed to a needle 16, the loop produced and temporarily caught by the looper 30 will be jerked off of the looper 30 on a subsequent stroke, as clip 41 is held open, to thereby form a low loop which passes over the looper 31. If, however, sufficient yarn 18 is fed to the needle 16 by yarn feed control 20, the held loop will be retained on the looper 30 and is subsequently cut by a knife, such as knife 40. Thus, yarns 18 selectively form high cut tufts and low loop tufts, as prescribed by the yarn feed control. The action of the yarn feed control 20 and loopers 30, dictate whether a cut or pile loop pile is formed, is well known. Thus, no more detail description is deemed necessary. The clip 41 is on one side of each looper and the knife 40 in the other.

The smaller rear needles 17 cooperating with the back cut pile looper 31 and produce from yarns 19, only uniform height cut pile. The function and purpose of the yarn feed control 21 feed only sufficient yarn 19 to assure a tight back stitch. Since the back or rear needle 17 must pass between a spring clip 41 of a front looper 30, the diameter or size of needles 17 must be small in comparison to the illustrated front needles 16. Thus, the yarns 19 are correspondingly small in size or diameter when compared to the yarns 18.

It is important that the front needles 16 be mounted for lateral shifting and that the rear needle 17 also be mounted for lateral shifting, independently of the needles 16. Machines having laterally shiftable needle bars are shown in U.S. Pat. No. 3,026,830 issued Mar. 27, 1962; U.S. Pat. No. 3,109,395 issued Nov. 5, 1963; U.S. Pat. No. 3,396,687, issued Aug. 13, 1968; U.S. Pat. No. 4,366,761 issued Jan. 4, 1983; and U.S. Pat. No. 4,630,558 issued Dec. 23, 1986. Therefore, a more detailed description of the laterally shiftable needle bars 46 and 47, and their needle shift controls 53 and 54 is not deemed necessary.

In FIG. 1, we have provided a main needle bar support 45 which extends transversely across the backing material 14 and is carried at the lower end of push rods 11 for vertical reciprocation by these push rods 11. The lower surface of the main needle bar support 45 slideably carries a front needle bar 46 and a rear needle bar 47. For this purpose, the main needle bar 45 is provided with a pair of parallel, transversely extending dovetail grooves 48 and 49 which respectively receive, therein, dovetail tongues 50 and 51 respectively on the front needle bar 46 and the rear needle bar 47.

Front needle bar 46 carries the transversely aligned, vertically disposed, parallel, equally spaced, downwardly protruding front needles 16 and the yarn guide member 22 which protrudes forwardly from bar 46. In similar fashion, the rear needle bar 47 carries the transversely aligned, vertically disposed, parallel, equally spaced, downwardly protruding, rear needles 17 and the yarn guide member 23.

As shown in FIG. 2, needle bars 46 and 47 are respectively provided with needle shift controls 53 and 54 which are respectively connected to the ends of needle bars 46 and 47 via links 55 and 56. Thus, upon actuation of control 53, needle bar 46 is moved laterally, in one direction or the other, as shown by the arrow on bar 46 in FIG. 2. Also, upon actuation of control 54, the needle bar 47 is moved laterally, in one direction or the other, as shown by the arrow on bar 47 is FIG. 2.

The bars 46 and 47 are incrementally shifted left or right by the distance between adjacent looper front loopers 30 or back loopers 31, as the case may be, so that when the needles 16 and 17 penetrate backing 14, each front needle 16 will be aligned with a front looper 30 and each back needle 17 will be aligned with a back looper 31. Thus, the needles 17 are staggered with respect to needles 18.

The shifting left or right of each needle bar usually takes place as while the needles 16 and 18 are retracted out of backing material 14; however, if shifting of both needles bars 46 and 47 are in the same direction and to the same extent, shifting can take place after the needles 16 and 18 have penetrated backing material 14 to provide for lateral shifting of the fabric by the movement of the needles, if desired.

By lateral shifting of the needle bars 46 and 47, a zig-zag back stitch is produced and the large cut tufts of yarns 19 can be made to hide the adjacent low loops of yarn 19.

Referring to FIGS. 3A and 3B, a portion of a typical tufted product produced by the present machine is depicted, in which a cut pile or tuft is illustrated by "X" and a loop pile is illustrated by an "O". In this illustration, the back needles 17 sew cut pile 70, only, and the front needles 16 sew either high cut piles 71 or low loop piles 72. The yarns 18 or 19 for each needle may be the same or different colors. When a low loop is formed by yarns 18, they may be totally obscured from view by the adjacent cut tufts or piles. When 2200 denier or larger yarns are used for yarns 18, a quite different and new appearance can be provided for the resulting product.

When the yarns are different colors and needle bars 46 and/or 47 are shifted left and/or right by the needle controls 53 and 54 a checked multicolor effect can be achieved.

While the yarn feed control 20 will dictate whether the yarns 18 will produce the cut pile 71 or the loop pile 72, the function of yarn feed control 21 is to regulate the feed of yarns 19 to assure just sufficient yarn for producing piles or tufts 70.

It will be obvious to those skilled in the art that many variations may be made in the embodiment chosen to illustrate the present invention, without departing from the scope thereof, as defined by the claims.

I claim:

1. A tufting machine of the type having a reciprocating needle bar support on one side of a bed over which a backing material is passed and reciprocating looper block on the other side of said backing material, the improvement comprising:

(a) a front needle bar carried by and laterally moveable with respect to said needle bar support;

(b) a back needle bar carried by moveable with respect to said needle bar support;

(c) a row of laterally spaced front needles carried by said front needle bar; said front needles having yarns which are inserted by said needles through said backing material for forming successive loops in said backing material;

(d) a row of laterally spaced back needles carried by said back needle bar, said back needles having yarns which are inserted by said back needles through said backing material for forming successive loops in said backing material;

(e) a yarn control for controlling the feed of yarn to said front needles;

(f) cut pile loopers protruding forwardly from said looper block for catching the loops sewn by said back needles;

(g) cut loop loopers protruding forwardly from said looper block for catching the loops sewn by said front loopers, said cut loop loopers being respectively disposed between said cut pile loopers;

(h) knives for cutting the loops of yarns caught and retained by said cut pile loopers;

(i) knives for cutting the loops caught and retained by said cut loop loopers;

(j) spring clips for said cut loop loopers so that a loop caught by a cut loop looper will be jerked off of said cut-loop looper and form a low loop when insufficient yarn is fed to a front needle to form a full loop; and (k) a needle shift control for said front needle bar for shifting said front needle bar laterally.

2. The tufting machine defined in claim 1 wherein said rear needle bar is laterally shiftable on said needle bar support and including a second needle sift control connected to said rear needle bar for laterally shifting said rear needle bar.

3. The tufting machine defined in claim 1 wherein said front needles are larger than said rear needles for receiving larger yarns than said rear needles, whereby the cut tufts produced by said front needles will essentially cover the low loops.

4. The tufting machine defined in claim 1 wherein said rear needle bar is laterally shiftable on said needle bar support and including a second needle shift control connected to said rear needle bar for laterally shifting said rear needle bar, said front needles being larger than said rear needles, whereby larger yarns are received by said larger needles.

5. The tufting machine defined in claim 1 wherein the shifting of said front needle bar is by increments equal to the spacing between said cut-loop loopers.

6. The tufting machine defined in claim 2 wherein the shifting of each of said needle bars is by distances equal to the spacing of their respective loopers.

7. The method of tufting comprising: passing a backing material in a longitudinal path, arranging a first transverse row of needles carrying yarns adjacent to one side of said backing material, arranging a second transverse row of needles carrying yarns adjacent to said first transverse row of needles, reciprocating said needles for inserting the yarns simultaneously through said backing material for forming successive loops of yarns in said backing material, moving one of said rows of needles laterally as the needles are reciprocated so as to produce a zig-zag line of successive loops of yarns sewn by said one of said rows of needles, and selectively cutting only certain of said loops sewn by one of the rows of needles.

8. The method defined in claim 7 including moving the other of said rows of needles laterally so as to produce a zig-zag line of successive loops of yarns sewn by said other of said rows of needles.

* * * * *